US007559745B2

(12) United States Patent
Falk et al.

(10) Patent No.: US 7,559,745 B2
(45) Date of Patent: Jul. 14, 2009

(54) TIP CLEARANCE CENTRIFUGAL COMPRESSOR IMPELLER

(75) Inventors: Daniel C. Falk, Middletown, CT (US); Normand P. Jacques, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 589 days.

(21) Appl. No.: 11/385,613

(22) Filed: Mar. 21, 2006

(65) Prior Publication Data

US 2007/0224047 A1 Sep. 27, 2007

(51) Int. Cl.
*F01D 5/04* (2006.01)

(52) U.S. Cl. ..... 416/188; 416/244 A; 416/248

(58) Field of Classification Search ..... 415/115; 416/181, 188, 213 R, 232, 223 B
See application file for complete search history.

(56) References Cited

U.S. PATENT DOCUMENTS 2,709,893 A * 6/1955 Birmann ..... 415/115
4,447,188 A * 5/1984 Davis et al. ..... 415/115
4,787,821 A * 11/1988 Cruse et al. ..... 416/185
5,961,287 A * 10/1999 Cairo ..... 416/97 R
6,499,953 B1 12/2002 Bellerose et al.
7,156,612 B2 * 1/2007 Warikoo et al. ..... 415/69

FOREIGN PATENT DOCUMENTS

JP 59-28098 2/1984

* cited by examiner

*Primary Examiner*—Richard Edgar
(74) *Attorney, Agent, or Firm*—Carlson, Gaskey & Olds

(57) ABSTRACT

An impeller includes first and second impeller portions that are secured to one another. An interior cavity is formed between the first and second portions. The first impeller portion supports multiple blades. The first and second impeller portions respectively include first and second surfaces that are secured to one another near a tip of the impeller. Inlet and outlet apertures are provided in the impeller and are in communication with the inner cavity to provide a cooling flow path there through. A circumferential gap is arranged between the first and second impeller portions opposite the tip to permit relative axial movement between the first and second impeller portions during centrifugal loading of the impeller.

18 Claims, 2 Drawing Sheets

TIP CLEARANCE CENTRIFUGAL COMPRESSOR IMPELLER

BACKGROUND OF THE INVENTION

This invention relates to a multi-piece hollow impeller and a method of manufacturing and using the same. The impeller is suitable for use in a radial flow centrifugal compressor, for example, or other rotary machines.

Small gas turbine compressors often use a radial compressor impeller as a last stage to boost air pressure. The radial compressor impeller includes a metal wheel with curved blades that accelerate the flow of air from an inlet near the inner diameter of the impeller to an exit near the outer diameter of the impeller. The impeller includes a single bore, or support structure, that carries the centrifugal loads on the impeller. The single radial impeller stage provides a pressure rise equivalent to the pressure ratio that several axial compressor stages can provide but with fewer parts. The single stage impeller also serves to reduce compressor axial length relative to axial compressor stages at an equivalent pressure rise.

Current impellers typically have an asymmetric solid, radar dish-shaped bore that tends to roll and deflect axially when under high centrifugal loads. In particular, conventional impellers axially deflect at the impeller tip in generally the opposite direction as airflow into the impeller inlet. The deflection is caused by centrifugal inertial loads on the asymmetric impeller and by temperature gradients in the impeller. As a result, the compressor must be designed with clearances to accommodate the deflection of the impeller tip throughout its entire operating range. The compressor is designed such that a desired clearance is obtained at a particular operating condition of the compressor, which results in less than desired performance during off design point operation reducing the overall efficiency of the compressor.

What is needed is an impeller that provides improved axial tip clearance throughout the entire operating range of the compressor.

SUMMARY OF THE INVENTION

The present invention provides an impeller for use in, for example, a compressor. The impeller is arranged within a housing that includes a shroud. The impeller is rotatable about an axis and includes first and second impeller portions that are secured to one another. The first impeller portion supports multiple blades that are arranged adjacent to the shroud. An impeller outlet and inlet are provided by the blades, and the impeller inlet is arranged radially inwardly from the impeller outlet. An interior cavity is formed between the first and second portions. The first and second impeller portions respectively include first and second surfaces that are secured to one another near a tip of the impeller, for example, by using a bonding material.

In an example embodiment, inlet and outlet holes are provided on the impeller and arranged in communication with the inner cavity to provide a cooling flow there through. In an example embodiment, a circumferential gap is arranged between the first and second impeller portions to permit relative axial movement between them during centrifugal loading of the impeller.

In one example, the impeller is manufactured by forging the first and second impeller portions. The first and second impeller portions are secured to one another using a bonding material arranged near the tip of the impeller by a transient liquid phase process, for example. The interior cavity is shaped for desired cooling and loading of the first and second impeller portions.

The inventive impeller provides improved dimensional stability of the impeller to reduce the running clearance needed between the impeller and housing throughout the operating range of the compressor.

The inventive impeller provides improved tip alignment between the impeller outlet and the diffuser inlet throughout the operating range of the compressor.

These and other features of the present invention can be best understood from the following specification and drawings, the following of which is a brief description.

DETAILED DESCRIPTION OF THE PREFERRED EMBODIMENT

Figure 1:
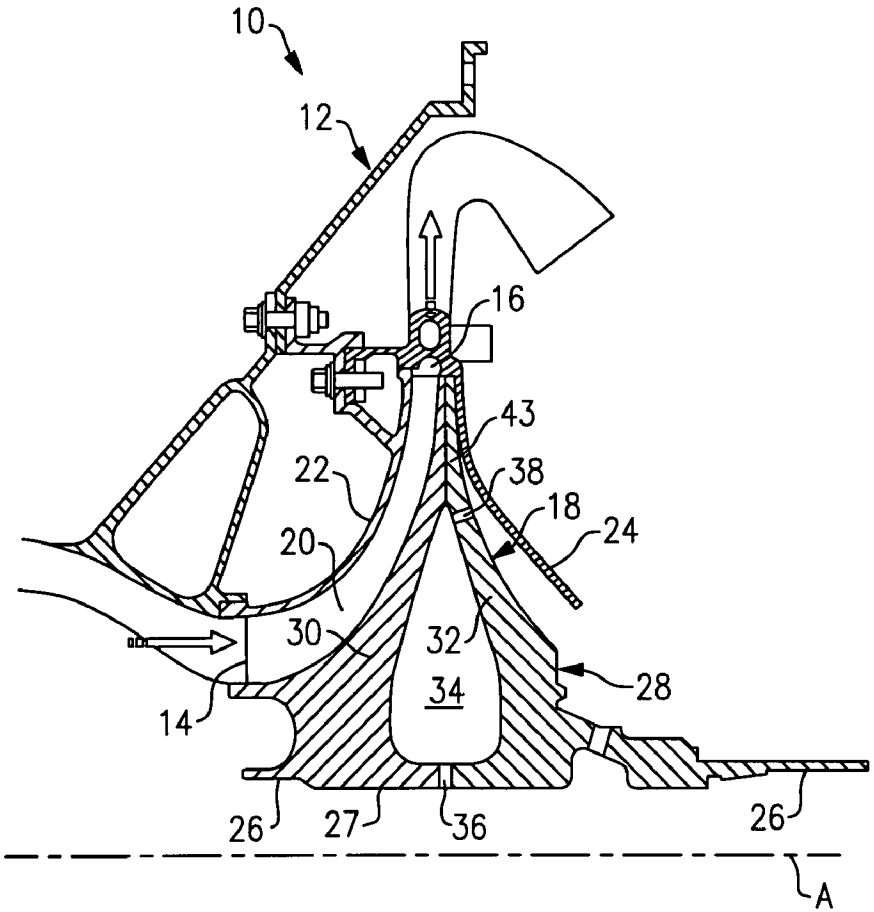
FIG. 1 is a cross-sectional view of a portion of a compressor.

A compressor 10 that provides a housing 12 is shown in FIG. 1. An impeller 18 is arranged within the housing 12 and rotates about an axis A. The impeller 18 includes an inlet 14 near an inner diameter of the impeller 18 and an outlet 16 near an outer diameter of the impeller 18. A shroud 22 is arranged on one side of the impeller 18 near blades 20 supported on the impeller 18. A structural housing 24 is arranged on an opposing or back side of the impeller 18. In the example shown, the structural housing 24 is exposed to high temperatures from leaking hot gases from compression and an adjacent burner (not shown) creating a temperature gradient.

The impeller 18 includes support surfaces 26 for rotationally supporting the impeller 18. A cylindrical surface 27 is arranged between the support surfaces 26, in the example shown. A bore 28 extends outwardly away from the cylindrical surface 27. The bore 28 is the structural portion of the impeller 18 that must withstand centrifugal loads and temperature gradients to maintain the dimensional stability of the impeller 18 throughout its operating range. In the prior art, the bore is a solid structure that supports the impeller blades in such a manner that an asymmetrical, radar dish-shaped impeller is provided.

Figure 2:
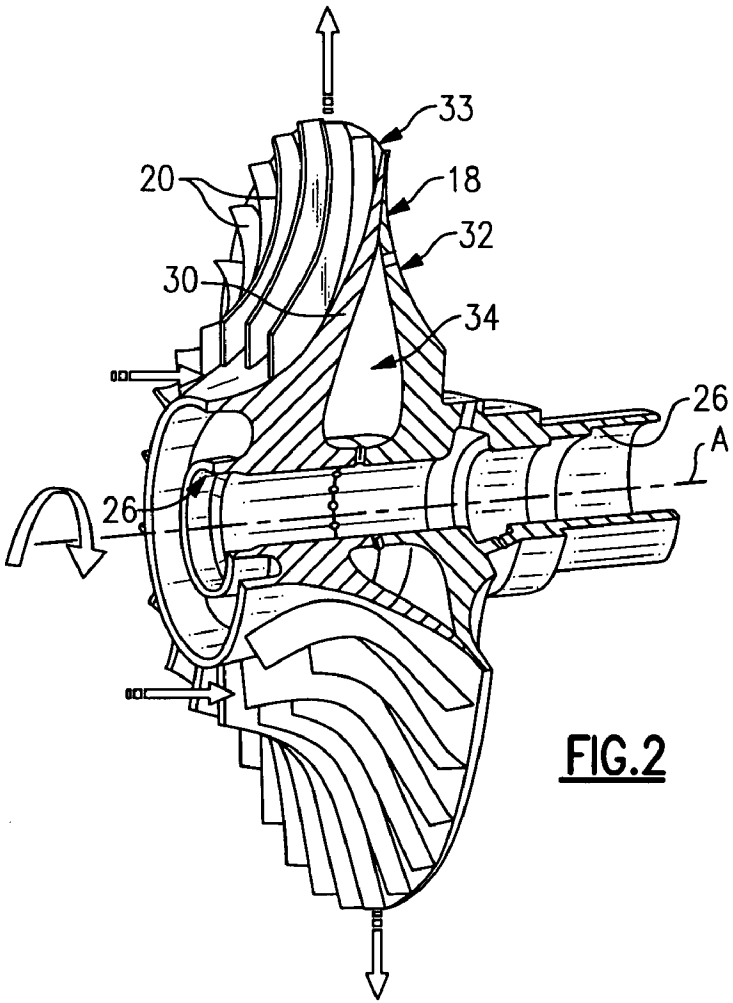
FIG. 2 is a perspective, partial sectional view of the impeller shown in FIG. 1.

The inventive impeller 18 is provided using multiple pieces. In the example shown, first and second impeller portions 30 and 32 are secured to one another to provide an interior cavity 34. As shown in FIG. 2, the first and second impeller portions 30 and 32 are arranged to provide a more symmetrically shaped impeller while an interior cavity 34 between the first and second impeller portions 30 and 32 avoids a weight penalty that would otherwise be associated with a more symmetrical impeller.

The first and second impeller portions 30 and 32 respectively include first and second surfaces 40 and 42 (FIG. 3) that are secured to one another near a tip 33 of the impeller 18. In one example, a bonding material 43 is used to secure the first and second impeller portions 30 and 32 to one another. For example, a transient liquid phase bonding process, which is known in the art, and appropriately selected material can be used. Transient liquid phase bonding is desirable since it does not result in flash extending into the interior cavity 34, which is inaccessible, preventing removal of any flash. In another example, inertia or friction weld bonding can be used.

Figure 3:
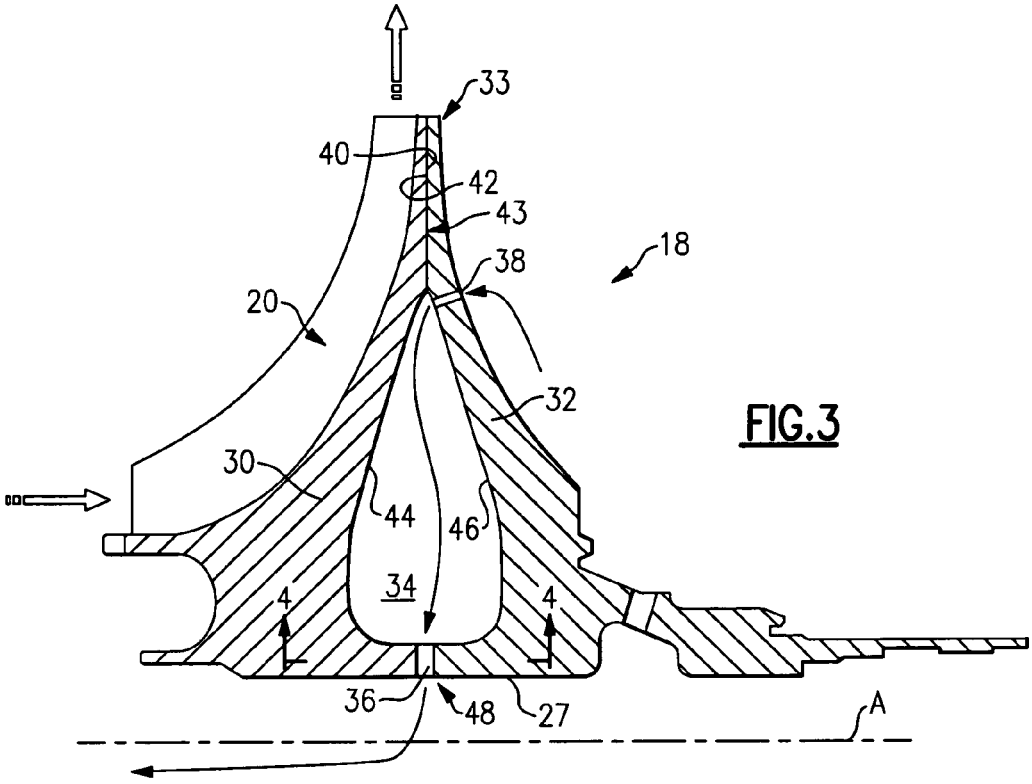
FIG. 3 is an enlarged cross-sectional view of the impeller shown in FIG. 1.

The interior cavity 34 can also be used to cool the impeller 18 to avoid distortion of the impeller 18 due to temperature gradients in the impeller. In one example, multiple outlet apertures 36 are provided on the cylindrical surface 27, as shown in FIG. 3. Multiple inlet apertures 38 are provided on the second impeller portion 32 near the structural housing 24, which is the hot side of the impeller 18. The inlet and outlet apertures 38 and 36 are in fluid communication with the interior cavity 34 to permit cooling flow through the interior cavity 34, as is shown by the arrows in FIG. 3. The inlet and outlet apertures 38 and 36 can be located and sized to obtain the desired cooling for the particular impeller application.

The first and second impeller portions 30 and 32 respectively include first and second contoured surfaces 44 and 46 that define the interior cavity 34. In the example shown, the first and second contoured surface 44 and 46 are generally mirror images of one another about an axial plane to minimize distortion of the impeller 18 due to centrifugal loading. The shape of the first and second contoured surfaces 44 and 46 can also be selected to achieve desired cooling and load distribution of the impeller 18.

Figure 4:
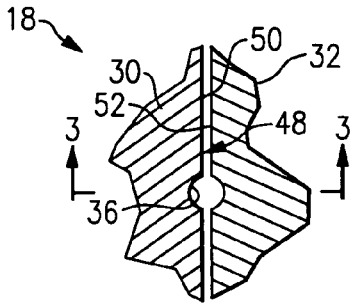
FIG. 4 is an enlarged cross-sectional view of the impeller taken along line 4-4 in FIG. 3.

The first and second impeller portions 30 and 32 tend to move axially toward one another under centrifugal loading. A circumferential gap 48 is provided between the first and second impeller portions 30 and 32 in the area of the cylindrical surface 27, as shown in FIG. 4. In the example shown, the first and second surfaces 40 and 42 and the circumferential gap 48 are generally aligned with one another. The circumferential gap 48 closes as the centrifugal load is increased, moving first and second edges 50 and 52 towards one another. The stress on the bond interface between first and second surfaces 40 and 42 is lessened with the presence of the circumferential gap 48 in some impeller applications. The compressive stresses near the circumferential gap 48 are lessened with the presence of the circumferential gap 48. The outlet apertures 36 are provided in the area of the circumferential gap 48 in the embodiment shown in FIG. 4.

Although several preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. An impeller for a rotary machine comprising:

first and second impeller portions secured to one another and forming an interior cavity there between, the first impeller portion supporting multiple blades; and wherein the first and second impeller portions provide a generally cylindrical surface coaxial with the axis, the cylindrical surface including a circumferential gap axially separating the first and second impeller portions a first axial width, and apertures provided at the circumferential gap, the apertures having a second axial width that is greater than the first axial width.

2. The impeller according to claim 1, wherein the impeller includes a rotational axis and the first and second impeller portions include a tip remote from the axis, the first and second impeller portions respectively include first and second surfaces secured to one another near the tip.

3. The impeller according to claim 2, wherein the first and second impeller portions respectively include first and second contoured surfaces defining the interior cavity, the first and second contoured surfaces generally mirror one another.

4. The impeller according to claim 2, wherein the circumferential gap and first and second surfaces are generally aligned with one another.

5. The impeller according to claim 2, wherein the cylindrical surface includes an outlet aperture and the second impeller portion includes an inlet aperture, the inlet and outlet apertures in communication with the interior cavity.

6. The impeller according to claim 1, wherein the apertures provide outlet apertures, and second impeller portions includes an inlet aperture, the inlet and outlet apertures in communication with the interior cavity.

7. The impeller according to claim 1, wherein the first and second impeller portions respectively include first and second surfaces secured to one another with a bonding material.

8. The impeller according to claim 1, wherein the first and second impeller portions are separated by a gap that is in communication with the interior cavity, the gap provided by first and second edges respectively of the first and second impeller portions, the first and second edges axially movable relative to one another.

9. The impeller according to claim 1, wherein the first and second impeller portions are secured to one another with a bonding material.

10. The impeller according to claim 1, comprising a stationary housing at least partially surrounding the impeller, the housing including a shroud adjacent to the blades and providing an impeller inlet and outlet between the shroud and first impeller portion, the impeller outlet positioned radially outwardly from the impeller inlet.

11. A compressor comprising:

a stationary housing including a shroud;

an impeller arranged within the housing and rotatable about an axis, the impeller including first and second impeller portions secured to one another and forming an interior cavity there between, the first impeller portion including a side supporting multiple blades on the side axially adjacent to the shroud, the blades providing an impeller outlet and inlet with the impeller inlet arranged radially inwardly from the impeller outlet; and wherein the impeller provides a cylindrical surface near the axis that includes an outlet aperture, and the second impeller portion includes an inlet aperture, the inlet and outlet apertures in communication with the interior cavity.

12. The compressor according to claim 11, wherein the housing includes a structural housing near the second impeller portion, wherein the inlet aperture is arranged in the second impeller portion near the structural housing.

13. The compressor according to claim 11, wherein the first and second impeller portions respectively include first and second surfaces secured to one another near a tip remote from the axis, and a circumferential gap opposite the tip separating the first and second impeller portions for permitting relative axial movement between the first and second impeller portions.

14. The compressor according to claim 11, wherein the first and second impeller portions each provide a support surface axially adjacent to the cylindrical surface, the cylindrical surface near a rotational axis of the impeller, the support surfaces configured to rotationally support the impeller.

15. A method of manufacturing an impeller comprising the steps of:

a) providing first and second impeller portions;

b) securing the first and second impeller portions to one another to form an interior cavity between the first and second impeller portions; and c) providing a circumferential gap located at a radially innermost location between the first and second impeller portions, the circumferential gap having a first axial width and adjoining the interior cavity, and the circumferential gap including apertures having a second axial width that is greater than the first axial width.

16. The method according to claim 15, wherein step a) includes forging the first and second impeller portions.

17. The method according to claim 15, wherein step b) includes bonding the first and second impeller portions to one another near a tip of the impeller remote from a rotational axis.

18. The method according to claim 15, comprising the steps of reducing the axial compression resulting from the deflection of the first and second impellers to decrease a width of the circumferential gap.

* * * * *

UNITED STATES PATENT AND TRADEMARK OFFICE

CERTIFICATE OF CORRECTION

PATENT NO. : 7,559,745 B2
APPLICATION NO. : 11/385613
DATED : July 14, 2009
INVENTOR(S) : Falk et al.

It is certified that error appears in the above-identified patent and that said Letters Patent is hereby corrected as shown below:

CLAIMS -

Claim 11, Column 4, Line 36, insert --and-- after first occurrence of "side".

Signed and Sealed this

Sixth Day of October, 2009

David J. Kappos

David J. Kappos
*Director of the United States Patent and Trademark Office*